US012179965B2

(12) United States Patent
Wu

(10) Patent No.: US 12,179,965 B2
(45) Date of Patent: Dec. 31, 2024

(54) SEALING COVER

(71) Applicant: Lengjer Metal & Plastic Co., Ltd., Dongguan (CN)

(72) Inventor: Ming-Feng Wu, Tainan (TW)

(73) Assignee: Lengjer Metal & PlasticCo., Ltd., Dongguan (CN)

( * ) Notice: Subject to any disclaimer, the term of this patent is extended or adjusted under 35 U.S.C. 154(b) by 98 days.

(21) Appl. No.: 18/191,691

(22) Filed: Mar. 28, 2023

(65) Prior Publication Data

US 2024/0228129 A1 Jul. 11, 2024

(30) Foreign Application Priority Data

Jan. 7, 2023 (TW) ..... 112200218

(51) Int. Cl.

| | |
|---|---|
| ***B65D 39/12*** | (2006.01) |
| ***B65D 39/16*** | (2006.01) |
| ***B65D 43/26*** | (2006.01) |
| ***B65D 45/02*** | (2006.01) |

(Continued)

(52) U.S. Cl.

CPC ..... *B65D 45/02* (2013.01); *B65D 39/16* (2013.01); *B65D 43/265* (2013.01); *B65D 45/327* (2013.01); *B65D 45/34* (2013.01); *B65D 2251/205* (2013.01); *B65D 2543/00231* (2013.01); *B65D 2543/00564* (2013.01); *B65D 2543/00842* (2013.01); *B65D 2543/00972* (2013.01)

(58) Field of Classification Search

CPC ..... B65D 2543/00972; B65D 2543/00564; B65D 2543/00842; B65D 2543/00231; B65D 2543/0087; B65D 2251/07; B65D 39/12; B65D 39/16; B65D 39/0052; B65D 45/34; B65D 45/327; B65D 43/265

USPC ..... 215/359, 294, 296; 220/234, 238, 262, 220/804, 803

See application file for complete search history.

(56) References Cited

U.S. PATENT DOCUMENTS

| | | | | |
|---|---|---|---|---|
| 11,358,759 | B2 * | 6/2022 | Yang | B65D 43/265 |
| 11,472,615 | B1 * | 10/2022 | Lu | B65D 53/02 |

(Continued)

FOREIGN PATENT DOCUMENTS

| | | | | |
|---|---|---|---|---|
| EP | 2174882 | A1 * | 4/2010 | B65D 39/12 |
| WO | WO-02072443 | A2 * | 9/2002 | B01L 3/50825 |
| WO | WO-2022183538 | A1 * | 9/2022 | B65D 39/12 |

*Primary Examiner* — Allan D Stevens

(74) *Attorney, Agent, or Firm* — Akerman LLP; Peter A. Chiabotti

(57) ABSTRACT

A sealing cover for covering an opening of a barrel body includes an outer cover body, an inner cover body, an airtight ring and an operating member. The outer cover body includes two pivot connecting portions. The airtight ring is sleeved on an outer peripheral surface of the inner cover body. The operating member is pivotally connected to the pivot connecting portions and the inner cover body. The operating member is operable to pivot so as to drive movement of the inner cover body between a sealed position and an unsealed position. When at the sealed position, the airtight ring is deformed and airtightly pressed between the barrel body and the outer cover body. When at the unsealed position, the airtight ring restores to its original shape and is configured not to be pressed between the barrel body and the outer cover body.

6 Claims, 4 Drawing Sheets

(51) Int. Cl.
*B65D 45/32* (2006.01)
*B65D 45/34* (2006.01)

(56) References Cited

U.S. PATENT DOCUMENTS

2012/0031902 A1* 2/2012 Gilbert ..... B65D 39/08
220/212.5
2022/0411145 A1* 12/2022 Shao ..... B65D 47/0804

* cited by examiner

SEALING COVER

CROSS-REFERENCE TO RELATED APPLICATION

This application claims priority to Taiwanese Utility Model Patent Application No. 112200218, filed on Jan. 7, 2023.

FIELD

The present disclosure relates to a cover, and more particularly to a sealing cover for sealing an opening of a barrel body.

BACKGROUND

A conventional sealing cover for sealing a barrel body includes an outer cover body abutting against the barrel body, an inner cover body disposed below the outer cover body, an airtight ring sleeved on an outer periphery of the inner cover body, and a transmission unit extending through the outer cover body and disposed on the inner cover body.

The transmission unit includes a driven member extending through the outer cover body and disposed on the inner cover body, a shift lever, a pivot pin pivotally connected to the driven member and the shift lever, and a resilient element connected between the outer cover body and the inner cover body. The transmission unit is operable to move the inner cover body upwardly relative to the outer cover body, and to drive the airtight ring to deform and abut against an inner peripheral surface of the barrel body so as to achieve sealing.

However, the number of assembly elements of the transmission unit of the conventional sealing cover is relatively great, so the assembly step is complicated, resulting in high production cost.

SUMMARY

Therefore, an object of the disclosure is to provide a sealing cover that can alleviate the drawback of the prior art.

According to the disclosure, the sealing cover adapted to cover an opening of a barrel body includes an outer cover body, an inner cover body, an airtight ring and an operating member. The outer cover body removably covers the opening of the barrel body, and includes two spaced-apart pivot connecting portions. The inner cover body is disposed below the outer cover body, is movable in a top-bottom direction, and includes a platform body which upwardly extends into the outer cover body. The platform body has two spaced apart rail holes. The airtight ring is sleeved on an outer peripheral surface of the inner cover body. The operating member includes two mounting parts respectively and pivotally connected to the pivot connecting portions. Each of the mounting parts has a sliding post that extends into a respective one of the rail holes of the platform body. The operating member is operable to pivot so that the sliding posts slide respectively in the rail holes to drive movement of the inner cover body relative to the outer cover body between a sealed position and an unsealed position. When at the sealed position, the airtight ring is deformed and airtightly pressed between the barrel body and the outer cover body. When at the unsealed position, the airtight ring restores to its original shape and is configured not to be pressed between the barrel body and the outer cover body.

BRIEF DESCRIPTION OF THE DRAWINGS

Other features and effects related to the present disclosure will be clearly presented in the embodying manner with reference to the drawings.

DETAILED DESCRIPTION

Figure 1:
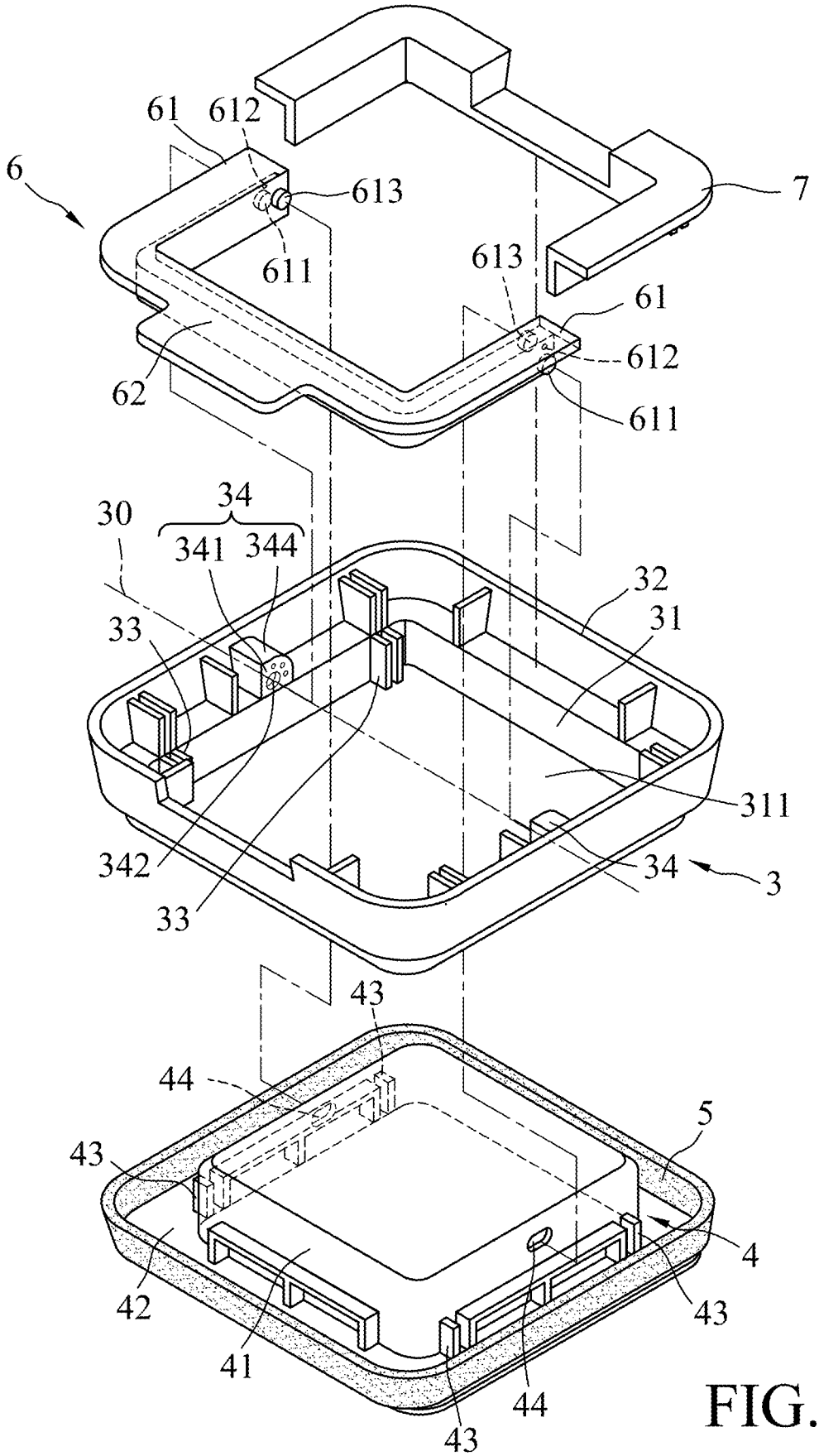
FIG. 1 is an exploded perspective view of an embodiment of a sealing cover according to the present disclosure.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
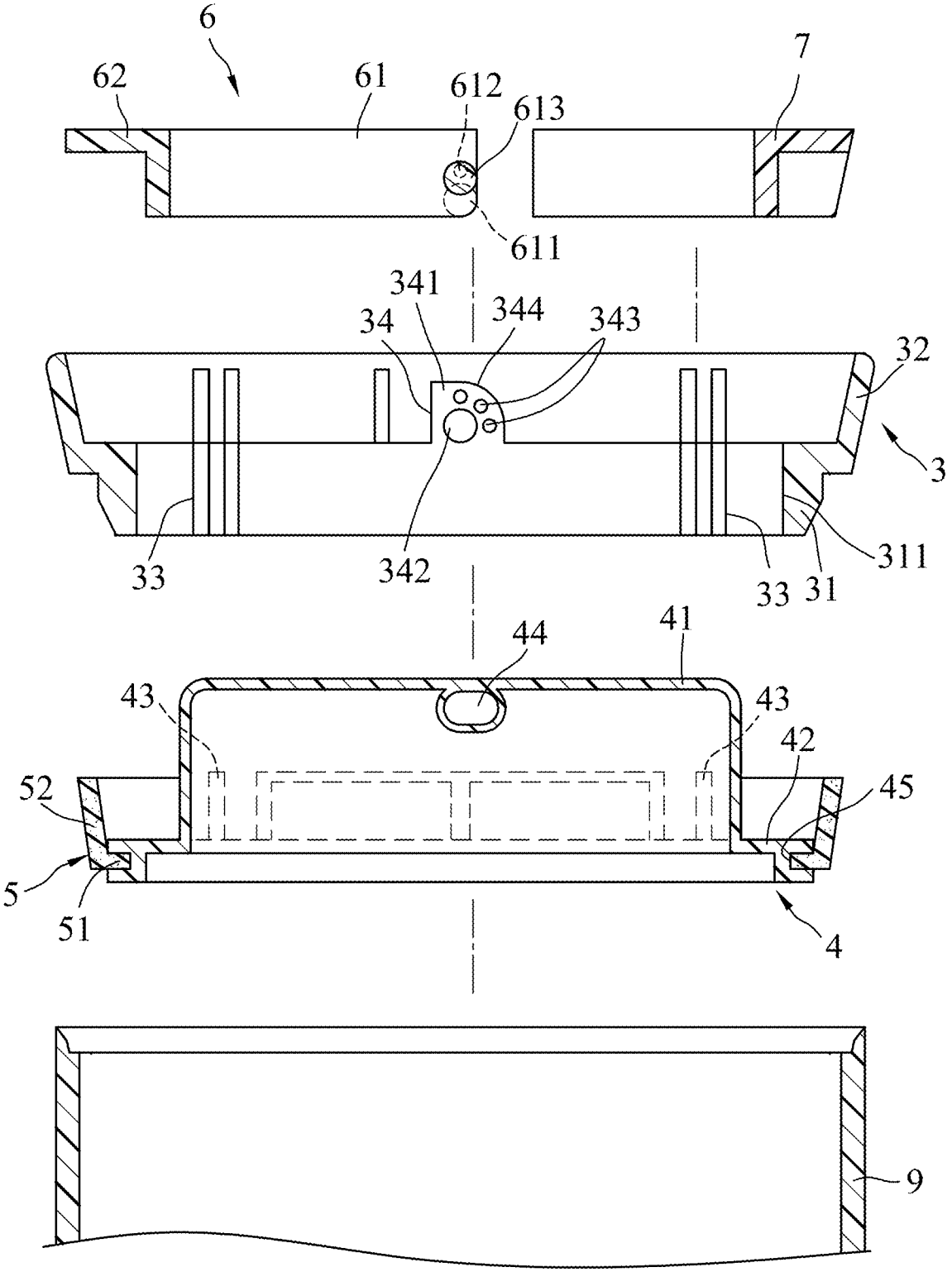
FIG. 2 is a fragmentary exploded sectional view illustrating the embodiment.
Figure 3:
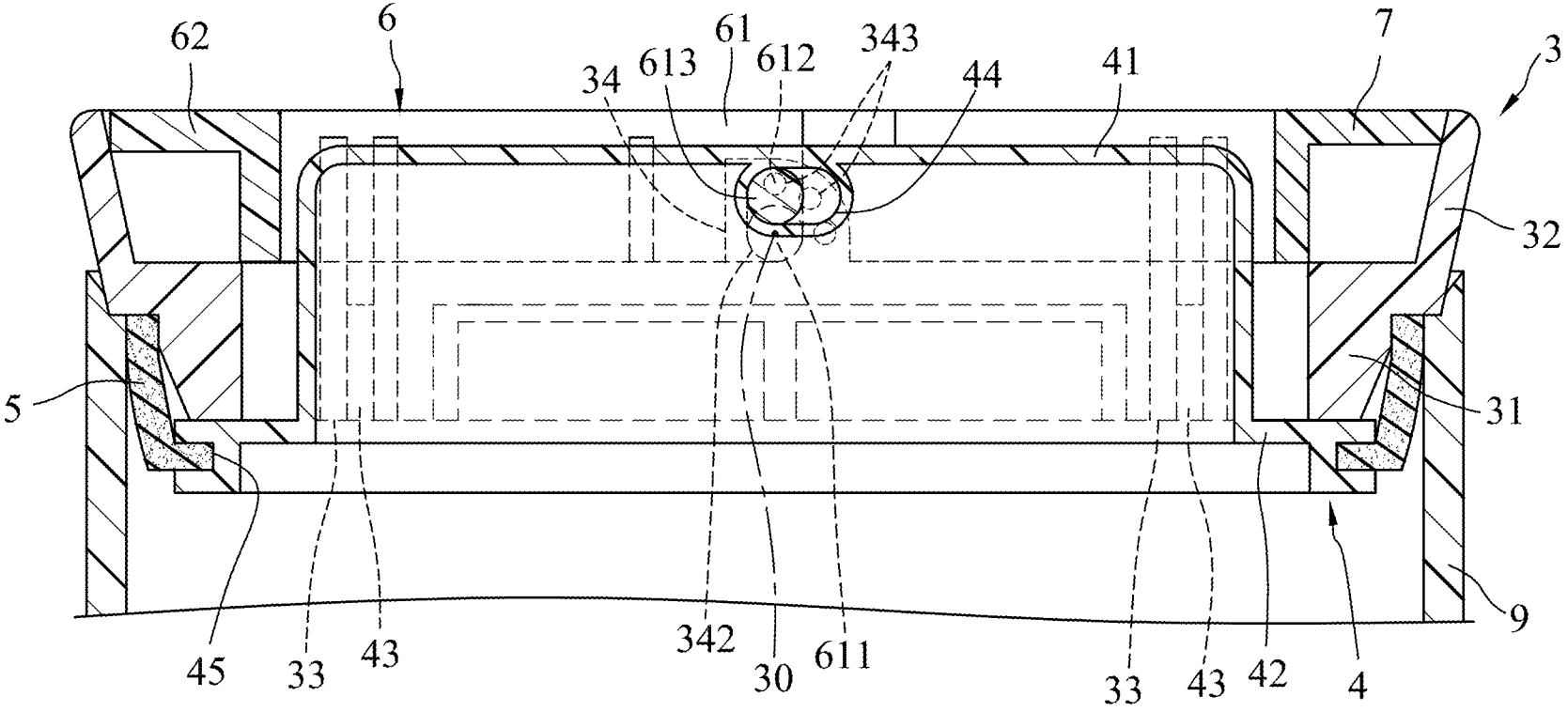
FIG. 3 is a fragmentary sectional view, illustrating an inner cover body of the embodiment at a sealed position.

Referring to FIGS. 1, 2, and 3, an embodiment of a sealing cover according to this disclosure is adapted for sealing an opening of a barrel body 9, and includes an outer cover body 3, an inner cover body 4 disposed below the outer cover body 3, an airtight ring 5 sleeved on an outer peripheral surface of the inner cover body 4, an operating member 6 pivotally disposed on the outer cover body 3, and a decorative plate 7 capped on the outer cover body 3.

The outer cover body 3 is substantially rectangular, and includes a lower surrounding wall 31 adapted for extending into the barrel body 9, an upper surrounding wall 32 extending upwardly from the lower surrounding wall 31 and having a width larger than that of the lower surrounding wall 31, a plurality of guide grooves 33 formed at an inner periphery of the lower surrounding wall 31 and extending in an top-bottom direction, and two pivot connecting portions 34 formed at an inner periphery of the upper surrounding wall 32 and spaced apart from each other along an axis 30.

The lower surrounding wall 31 defines a rectangular through hole 311 that is centrally located in the lower surrounding wall 31. Each of the pivot connecting portions 34 has a pivot connecting surface 341 facing the other one of the pivot connecting portions 34, and an arcuate surface 344 connected to the pivot connecting surface 341. The pivot connecting surface 341 of each of the pivot connecting portions 34 is formed with a pivot hole 342 centered at the axis 30, and a plurality of angularly spaced-apart positioning holes 343 disposed around the axis 30. The arcuate surface 344 of each of the pivot connecting portions 34 extends upwardly from one side of a bottom portion of the pivot connecting portion 34 that is proximate to the positioning holes 343, and extends around the axis 30.

The inner cover body 4 includes a platform body 41 which is rectangular and which extends upwardly into the through hole 311 of the outer cover body 3, a ring-shaped base wall part 42 extending outwardly and horizontally from a periphery of the platform body 41, and a plurality of rib portions 43 extending upwardly from the base wall part 42 and respectively corresponding in position to and slidable engaging the guide grooves 33. The platform body 41 has two spaced-apart and laterally extending rail holes 44. The base wall part 42 has an annular insertion groove 45 permitting the airtight ring 5 to be engaged thereinto.

The airtight ring 5 includes a ring-shaped first ring portion 51 coupled to the insertion groove 45 and sleeved on the base wall part 42, and a second ring portion 52 extending upwardly from an outer periphery of the first ring portion 51 and located between an inner peripheral surface of the barrel body 9 and the outer cover body 3 when the sealing cover covers the opening of the barrel body 9.

The operating member 6 is generally U-shaped, is at least partially disposed between the upper surrounding wall 32 of the outer cover body 3 and the platform body 41 of the inner cover body 4, and is configured to drive the inner cover body 4 to move up and down relative to the outer cover body 3. The operating member 6 includes two mounting parts 61 respectively located at two opposite ends thereof and respectively pivotally connected to the pivot connecting portions 34 of the outer cover body 3, and a connecting part 62 connected between the mounting parts 61.

Each of the mounting parts 61 abuts against a respective one of the arcuate surfaces 344 of pivot connecting portions 34, and has a pivot pin 611 rotatably extending into the pivot hole 342 of a respective one of pivot connecting portions 34, a positioning protrusion 612 disposed proximate to the pivot pin 611, and a sliding post 613 extending into a respective one of the rail holes 44 and configured not to be centered at the axis 30. Each of the positioning protrusions 612 is removably engaged to one of the positioning holes 343 of the corresponding pivot connecting portion 34.

The decorative plate 7 is generally U-shaped, and is disposed adjacent to the operating member 6 and between the upper surrounding wall 32 of the outer cover body 3 and the platform body 41. The decorative plate 7 is configured to cooperate with the operating member 6 and the platform body 41 of the inner cover body 4 for covering the upper surrounding wall 32 of the outer cover body 3.

Figure 4:
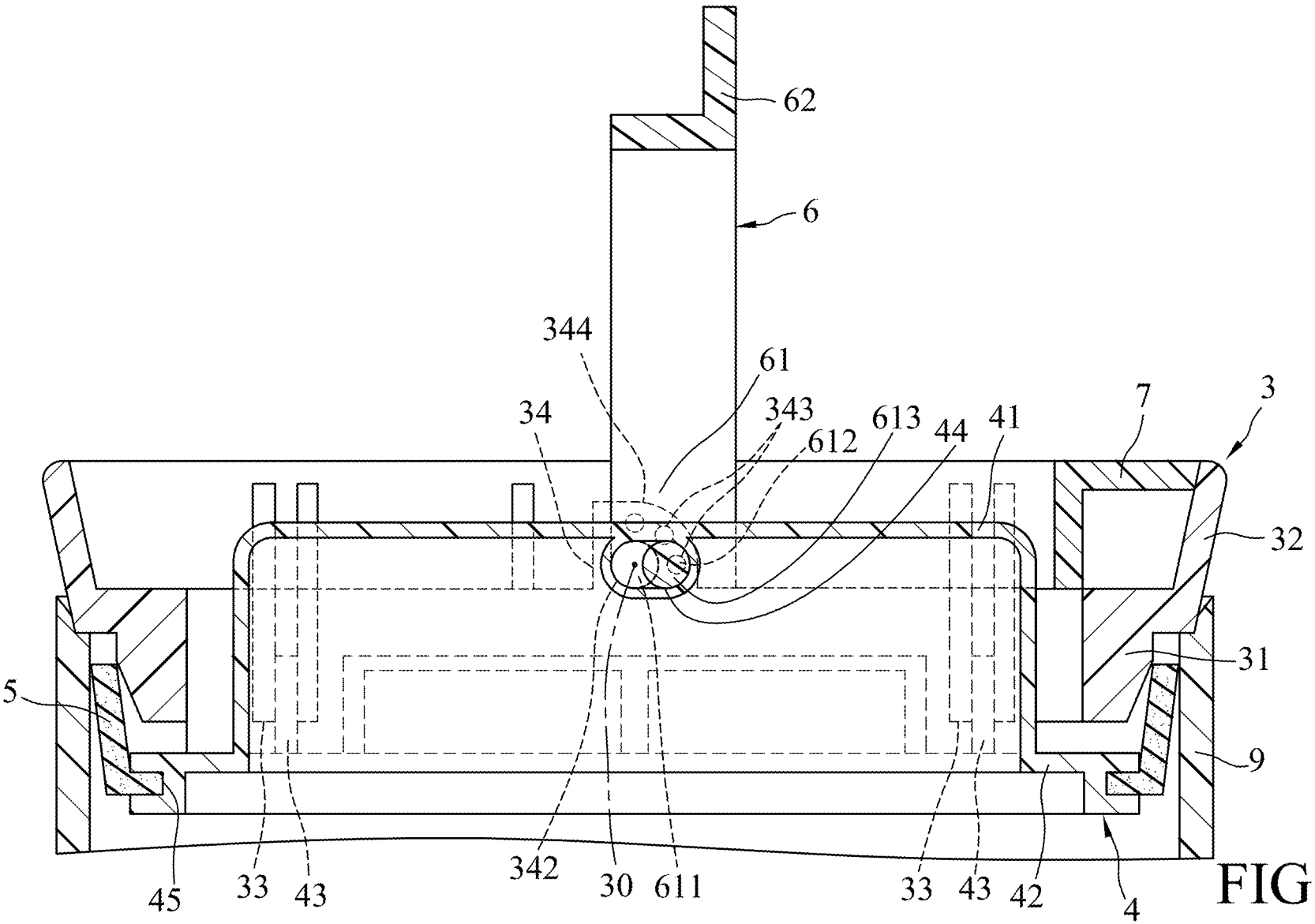
FIG. 4 is a fragmentary sectional view, illustrating the inner cover body at an unsealed position.

Referring to FIGS. 1, 3 and 4, when this embodiment is used, the operating member 6 can be rotated about the axis 30, so as to drive the inner cover body 4 to move between a sealed position (see FIG. 3) and an unsealed position (see FIG. 4) relative to the outer cover body 3. When the inner cover body 4 is at the sealed position, the operating member 6 is oriented horizontally and abuts against the upper surrounding wall 32. The airtight ring 5 is pressed between and deformed by the inner peripheral surface of the barrel body 9 and the outer cover body 3 and abuts tightly between the barrel body 9 and the outer cover body 3, so that an airtight effect can be achieved. The connecting part 62 and the mounting parts 61 of the operating member 6 surround the platform body 41 when the inner cover body 4 is at the sealed position.

When the operating member 6 is operated to pivot, the mounting parts 61 respectively slide along the arcuate surfaces 344 to be upright relative to the outer cover body 3, and can drive the inner cover body 4 to move downwardly to the unsealed position. During the movement of the inner cover body 4 from the sealed position to the unsealed position, the sliding posts 613 rotate about the axis 30. Each of the sliding posts 613 is driven to rotate about the axis 30 and to slide in the respective one of the rail holes 44. Since the rib portions 43 of the inner cover body 4 are respectively slidable in the top-bottom direction in the guide grooves 33 of the outer cover body 3, each of the sliding posts 613 push the inner cover body 4 downward while sliding along the corresponding rail hole 44, so that the inner cover body 4 moves downward relative to the outer cover body 3, and the airtight ring 5 is driven to move downward synchronously until the inner cover body 4 is moved to the unsealed position. When the inner cover body 4 is at the unsealed position, the airtight ring 5 is no longer tightly pushed by the barrel body 9 and the outer cover body 3, and the airtight ring 5 restores to its original shape and is no longer pressed between the inner peripheral surface of the barrel body 9 and the outer cover body 3.

In summary, through the design of the operating member 6 being pivoted to the outer cover body 3, and having the sliding posts 613, and with the inner cover body 4 having a design in which the sliding posts 613 extend into the rail holes 44, the inner cover body 4 can be driven to move upward and downward relative to the outer cover body 3 through a single element (i.e., the operating member 6), so as to achieve the purpose of sealing. Compared to other conventional seal cover assemblies, the current design has less elements, assembly steps can be reduced to improve assembly efficiency, thereby achieving benefits of reducing production cost. Furthermore, the arcuate surfaces 344 of the pivot connecting portions 34 are designed so as to facilitate smooth pivoting operation of the operating member 6, thereby enhancing convenience of operation.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A sealing cover adapted to cover an opening of a barrel body, comprising:

an outer cover body adapted to removably cover the opening of the barrel body, and including two spaced-apart pivot connecting portions;

an inner cover body disposed below said outer cover body, movable in a top-bottom direction, and including a platform body which upwardly extends into said outer cover body, said platform body having two spaced-apart rail holes;

an airtight ring sleeved on an outer peripheral surface of said inner cover body; and an operating member including two mounting parts respectively and pivotally connected to said pivot connecting portions, each of said mounting parts having a sliding post that extends into a respective one of said rail holes of said platform body, said operating member being operable to pivot so that said sliding posts slide respectively in said rail holes to drive movement of said inner cover body relative to said outer cover body between a sealed position and an unsealed position, when at the sealed position, said airtight ring being deformed and airtightly pressed between the barrel body and said outer cover body, when at the unsealed position, said airtight ring restoring to its original shape and configured not to be pressed between the barrel body and said outer cover body.

2. The sealing cover as claimed in claim 1, wherein said pivot connecting portions are formed at an inner peripheral surface of said outer cover body, and are spaced apart from each other along an axis, said sliding posts being configured not to be centered at the axis.

3. The sealing cover as claimed in claim 2, wherein each of said pivot connecting portions has a pivot hole, each of said mounting parts further having a pivot pin disposed on a surface opposite to said sliding post of said mounting part, said pivot pin of each of said mounting parts rotatably extending into a respective one of said pivot holes of said pivot connecting portions.

4. The sealing cover as claimed in claim 3, wherein each of said pivot connecting portions further has a plurality of angularly spaced-apart positioning holes disposed around the axis, each of said mounting parts further having a positioning protrusion proximate to said pivot pin, each of said positioning protrusions of said mounting parts being operable to be removably engaged to one of said positioning holes of the respective one of said pivot connecting portions.

5. The sealing cover as claimed in claim 1, wherein said outer cover body further includes a lower surrounding wall defining a through hole, and a plurality of guide grooves formed at an inner peripheral surface of said lower surrounding wall, said platform body extending upwardly into said through hole, said inner cover body further including a base wall part that extends outwardly from a periphery of said platform body, and a plurality of rib portions that extend upwardly from said base wall part and that are respectively slidable in the top-bottom direction in said guide grooves.

6. The sealing cover as claimed in claim 1, wherein each of said pivot connecting portions has an arcuate surface abutting against a respective one of said mounting parts.

* * * * *